US010060201B2

(12) United States Patent
Wase

(10) Patent No.: US 10,060,201 B2
(45) Date of Patent: Aug. 28, 2018

(54) DEVICE FOR HANDLING DRILL STRING COMPONENTS AND ROCK DRILL RIG

(71) Applicant: EPIROC ROCK DRILLS AKTIEBOLAG, Örebro (SE)

(72) Inventor: Lars Wase, Danderyd (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 143 days.

(21) Appl. No.: 14/898,010

(22) PCT Filed: Jun. 26, 2014

(86) PCT No.: PCT/SE2014/000093
§ 371 (c)(1),
(2) Date: Dec. 11, 2015

(87) PCT Pub. No.: WO2015/016758
PCT Pub. Date: Feb. 5, 2015

(65) Prior Publication Data

US 2016/0130890 A1 May 12, 2016

(30) Foreign Application Priority Data

Aug. 2, 2013 (SE) ..... 1350927

(51) Int. Cl.
*E21B 19/15* (2006.01)
*E21B 19/00* (2006.01)

(52) U.S. Cl.
CPC ..... *E21B 19/155* (2013.01); *E21B 19/00* (2013.01)

(58) Field of Classification Search
CPC ..... E21B 19/00; E21B 19/155
See application file for complete search history.

(56) References Cited

U.S. PATENT DOCUMENTS 2,113,270 A * 4/1938 Hall ..... E21B 19/155 414/22.57
2,615,585 A * 10/1952 Menhall ..... E21B 19/155 414/22.57

(Continued)

FOREIGN PATENT DOCUMENTS

CL 201503600 A1 7/2016
CL 201503676 A1 7/2016

(Continued)

OTHER PUBLICATIONS

PCT/ISA/210—International Search Report—dated Nov. 14, 2014 (Issued in Application No. PCT/SE2014/000093).

(Continued)

*Primary Examiner* — James G Sayre
(74) *Attorney, Agent, or Firm* — Venable LLP; Jeffri A. Kaminski

(57) ABSTRACT

A handling device for handling drill string components in a rock drill rig which includes a rotator device being arranged for rotation and driving of a drill string component and being supported movable to and fro on a feed beam. The handling device includes an introducing unit configured to introduce drill string components into respectively remove drill string components from a drill string position of the rock drill rig. A guiding beam includes a longitudinal guide. A gripper shuttle is drivingly displaceable along the longitudinal guide. The gripper shuttle includes a pivotally arranged guiding gripper for gripping a first end region of a drill string component. The gripper shuttle carries a drive motor for driving a drive wheel. The drive wheel is disengageable to allow essentially free movement of the gripper shuttle along the longitudinal guide. Also, a rock drill rig.

15 Claims, 4 Drawing Sheets

(56) References Cited

U.S. PATENT DOCUMENTS

| | | | | |
|---|---|---|---|---|
| 2,643,007 | A * | 6/1953 | Gray | E21B 19/155 414/22.54 |
| 4,081,084 | A | 3/1978 | Guinn et al. | |
| 4,439,091 | A | 3/1984 | Frias | |
| 6,189,620 | B1 | 2/2001 | McDowell | |
| 6,634,443 | B1 * | 10/2003 | Paech | E21B 15/04 175/85 |
| 6,969,223 | B2 * | 11/2005 | Tolmon | E21B 19/155 414/22.54 |
| 7,883,309 | B2 * | 2/2011 | Smith | E21B 19/155 212/231 |
| 8,016,536 | B2 * | 9/2011 | Gerber | E21B 19/00 414/22.58 |
| 2002/0195142 | A1 * | 12/2002 | Follett | E21B 19/00 137/315.02 |
| 2004/0197166 | A1 * | 10/2004 | Tolman | E21B 19/155 414/22.51 |
| 2005/0161227 | A1 | 7/2005 | Hayes et al. | |
| 2007/0286708 | A1 * | 12/2007 | Smith | E21B 19/155 414/22.58 |
| 2011/0091304 | A1 | 4/2011 | Tetley et al. | |

FOREIGN PATENT DOCUMENTS

| | | | |
|---|---|---|---|
| EP | 1916379 | A1 | 4/2008 |
| GB | 2047306 | A | 11/1980 |
| GB | 2334270 | A | 8/1999 |
| WO | WO-2013/176618 | A1 | 11/2013 |
| WO | WO-2014003646 | A1 | 1/2014 |

OTHER PUBLICATIONS

PCT/ISA/237—Written Opinion of the International Searching Authority—dated Nov. 14, 2014 (Issued in Application No. PCT/SE2014/000093).

Chilean Office Action dated Jan. 31, 2018 issued in corresponding Chilean Patent Application No. 201503677 (10 pages).

* cited by examiner

DEVICE FOR HANDLING DRILL STRING COMPONENTS AND ROCK DRILL RIG

CROSS-REFERENCE TO RELATED APPLICATIONS

The application claims priority to Swedish patent application 1350927-8 filed 2 Aug. 2013 and is the national phase under 35 U.S.C. § 371 of PCT/SE2014/000093 filed 26 Jun. 2014.

FIELD OF THE INVENTION

The invention concerns a handling device for handling drill string components in a rock drill rig which includes a rotator device being arranged for rotation and driving of a drill string component and being supported movable to and fro on a feed beam, wherein the handling device includes means for introducing drill string components into respectively remove drill string components from a drill string position of the rock drill rig. The invention also relates to a rock drill rig equipped with such a handling device.

BACKGROUND OF THE INVENTION

Core drilling for exploration purposes is usually performed with rock drill rigs, wherein the drill string components are placed in the active drill string position, lifted up from and lowered down into the drill hole with a winch. The winch wire is fastened to the uppermost drill string component with the aid of a lifting plug. Since core drilling aims to extract a drilled-out core of rock to be examined, tubular drill string components are used. During lifting of the drill string, which is performed frequently for exchange of drill bits, the string of tubes is lifted unit by unit, whereby the separate tubes are released from each other with the aid of the rotator device of the drill rig in co-operation with a lower tube holder.

Final release of a tube to be brought away from the drill string is today at least partly performed manually by the operators, this handling including final threading-off and lifting and guiding of the tube to an area of a tube magazine.

During lowering of the drill string, the working steps are performed reversely such that new drill string components in the form of tubes are successively lifted to a position where they are aligned with the drill string and threaded together by the operator. These working steps are straining for the operator and involve a risk of being subject to lifting and squeezing injuries for the operator which is not negligible.

Core drilling is often performed to very great depths, such as for example to drill length between 1000-2000 m. Because of the drill bit in operation being subject to wear, it has to be replaced relatively often, which results in that the entire drill string has to be lifted up from the drill hole, be dismounted into drill string components, the worn drill bit be removed and be replaced by a new one, whereupon the drill string can again be lowered down into the hole. Thereupon a further distance is drilled until the drill bit has to be replaced again etc. During the drilling, a flushing liquid swivel is connected to the uppermost end of the drill string for supplying flushing liquid for transporting away rock material having been disintegrated during drilling.

SUMMARY OF THE INVENTION

It is an aim of the invention to provide a device of the above kind, wherein the problems according to the above are addressed and at least partly solved.

This is achieved in respect of a device according to the above in that the handling device includes a guiding beam, which is arranged to extend laterally from the feed beam while forming an angle thereto, and which includes a longitudinal guide, that a gripper shuttle is drivingly displaceable along the longitudinal guide, wherein the gripper shuttle includes a pivotally arranged guiding gripper for gripping a first end region of a drill string component, the other end region of which been arranged to be in engagement with a lifting plug, that the gripper shuttle carries a drive motor for driving a drive wheel for co-operation with a drive track on the guiding beam, and that the drive wheel is disengageable to allow essentially free movement of the gripper shuttle along the longitudinal guide.

As a contrast to using a chain or the like for driving the gripper shuttle, the use of a drive wheel gives a higher degree of flexibility and is not suffering from disadvantages such as fixed length with plural limitations.

The solution according to the invention instead makes the driving non-dimensional, which here means that it is possible to make the guiding beam as long as required with simple modifications only of the arrangement for feed line to the drive motor. The lines (for example hydraulic hoses) to the gripper shuttle can be extended if the guiding beam is extended.

The guiding beam supporting the gripper shuttle is mounted standing at the side of the feed beam which makes the invention simple to use without making the rig too complicated.

By the drive wheel being disengageable for allowing an essentially free movement of the gripper shuttle along the longitudinal guide, it is permitted that the gripper shuttle during certain parts of a process, when a drill string component is to be introduced or be removed from a drill string position, is entirely controlled dependent on tension in the lifting wire. No correlated drive between the drive motor and the lifting winch will then be required. Through the grip of the guiding gripper on the lower end portion of the drill string component, the movements thereof will be sufficiently controlled so as to avoid excessive movements. During certain parts of the gripper shuttle movements, the drive motor will then simply be engaged to provide necessary power and guidance to desired positions.

Through the arrangement according to the invention, the handling during the process to lift and to introduce a drill string component with a lifting wire to the drill string position as well as during the process to lift and remove a drill string component from the drill string position is facilitated.

Preferably the drive wheel is a wheel with which the drive track can have a suitably shape, for example planar surface on the guiding beam with or without friction-increasing surface structures. The wheel is suitably a filled ring and can possibly include a core of a softer rubber-like material but can also be a pneumatic wheel. It is not excluded that the drive wheel is e.g. a gear wheel in gear with a rack gearing which is positioned along the guiding beam.

Preferably the contact pressure of the drive wheel against the drive track is adjustable to compensate for low friction during rain for example, wherein the contact pressure can be increased.

It is preferred that the drive wheel is disengageable by being put out of engagement with said drive track. This can be achieved through a manoeuvrable shaft coupling but is most preferred in that the drive wheel is supported by a holder which with the aid of a power unit is movable in respect of a body of the gripper shuttle. This solution allows this engagement as well as the pressure variation. The holder is most preferably swingable around a pivot axis with the aid of a power unit in the form of a hydraulic cylinder acting between the main part of the gripper shuttle and the holder.

It is preferred that the longitudinal guide includes guiding strips arranged lengthwise on the guiding beam and facing different directions sideways, and that the gripper shuttle includes guiding means co-operating with the guiding strips. This solution gives good, reliable and stable guiding with little friction. It is preferred that the guiding means are guiding rollers. As an alternative, slide guides can, however, be used.

The guiding gripper is preferably positioned on an arm being pivotal in respect of a main part of the gripper shuttle, suitably being pivotal between a first position for gripping a drill string component in the drill string position and a second position for gripping a drill string component in a delivering position. When the first is an adjustable position, the pivotal position of the arm can be easily adjusted to prevailing setting parameters of the rig.

It is also preferred that the guiding gripper is adjustable for adaption to drill string components of different sizes. This can be achieved in that a free space between grip jaws and a counter stay portion of the guiding gripper is varied related to intended dimensions of a drill string component intended for gripping.

By the guiding beam being attachable pivotal around a first pivot axis in connection with said feed beam, the advantage is obtained that it is possible to adjust automatically for adjustments to the rig.

Suitably the device according to the invention includes a gripping unit which is arranged to engage an end portion of a first drill string component and an end portion of a second drill string component respectively.

For the purpose of effectively and securely ensuring accurate alignment between the gripping unit and the drill string component being supported by the swing arm, according to the invention a guiding beam is provided which is arranged and constructed so as to form mechanical stop for the gripping unit in one position as well as for the swing arm in the delivering position. For this purpose the guiding beam can be fastened at its end position to the respective region of an axis for swinging the gripping unit and a swing axis for the swing arm. This arrangement results in that the guiding beam in each set position for the drill rig, for example with different inclinations of a feed beam, with a varying inclination to the ground of the rig and different vertical positions for the parts of the rig, more or less automatically on the one hand setting reference through said mechanical stop, on the other hand more or less automatically also provide suitable end positioning of the drill string component being supported by the swing arm in respect of the gripping unit.

It is preferred that the guiding beam is attachable to the rig and in particular to the feed beam even if it is also within the scope of the invention that it is placed standing free from the rig and the feed beam. In particular it is preferred that the guiding beam is attachable pivotally around a first pivot axis in connection to a region of the first swing axis being the swing axis of the gripping unit, and in particular that the first pivot axis is at least essentially co-axial with the first swing axis. It is also preferred that the guiding beam is attachable pivotally around a second pivot axis in connection to a region of the second swing axis being the swing axis of the swing arm, and in particularly that the second pivot axis is at least essentially co-axial with the second swing axis. These arrangements taken one by one facilitate and can, particularly taken together, even eliminate the need of adjusting the guiding beam and/or means co-operating therewith on the gripping unit and the swing arm respectably after the positioning of the rig or even after unintentional movement of the rig or of the support (such as the magazine) for the end of the guiding beam facing away from the rig.

In the first position, the gripping unit is positioned for engaging an end portion of a first drill string component respectively an end portion of a second drill string component. In the second position, the gripping unit is positioned to engage in an alignment with an end portion of a drill string component to be introduced to respectively be removed from said active drill string position.

Suitably the guiding beam i.a. from reasons of production has a linear extension.

The invention also relates to a rock drill rig including a rotator device for rotation and driving a drill string and being supported movable to and fro by a feed beam, and a handling device according to the above.

The invention will now be described in greater detail by way of embodiments and with reference to the annexed drawings.

DESCRIPTION OF EMBODIMENTS

Figure 1:
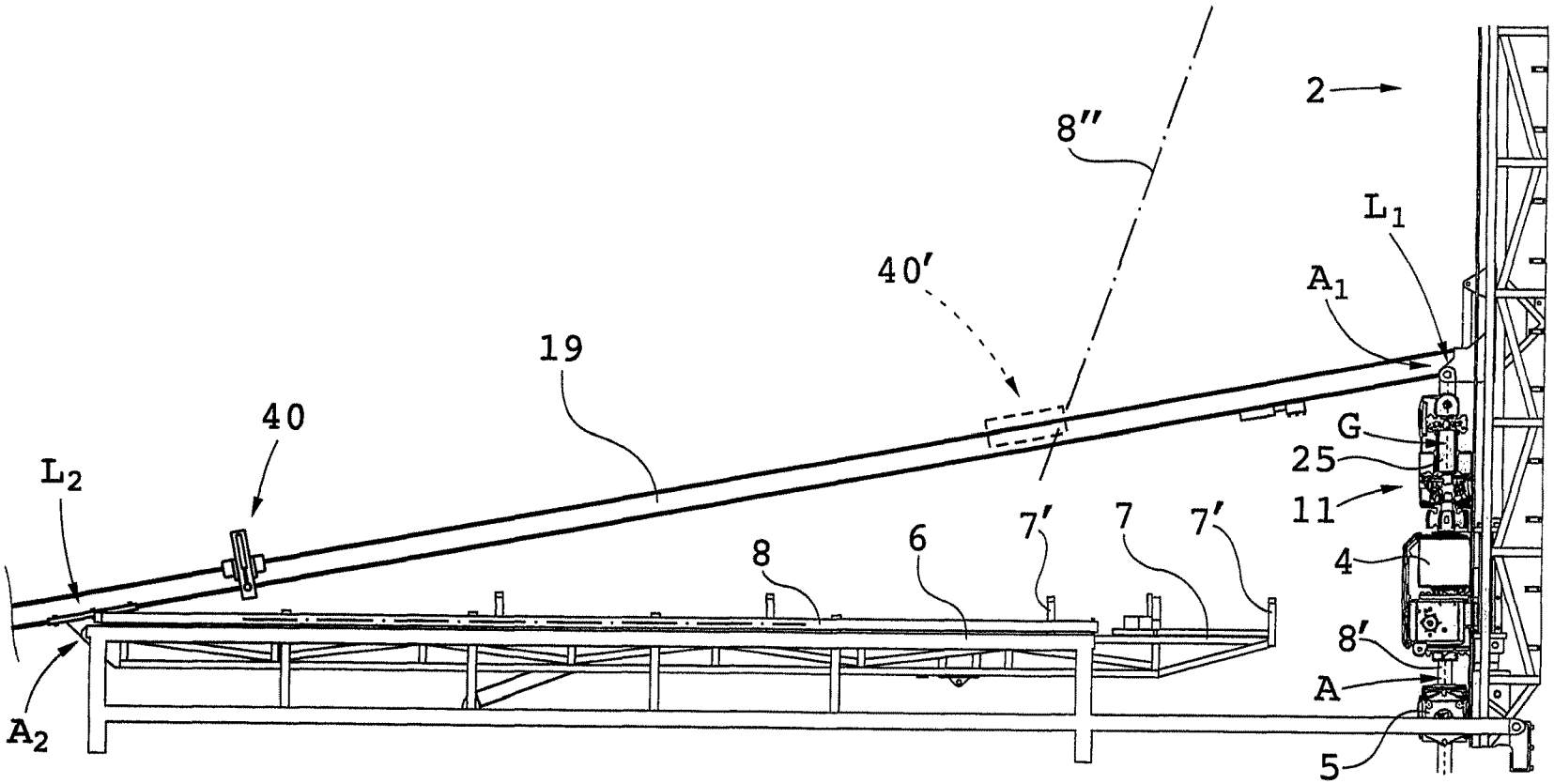
FIG. 1 shows in a side view a rock drill rig for core drilling provided with a handling device according to the invention and in connection with a magazine for drill string components.

FIG. 1 shows a feed beam 2 of a rock drill rig for core drilling being adjustable in different angles. The rig includes a rotator device 4, which is supported on the feed beam 2 for movement to and fro. Below (in the Figure) the rotator device 4 is arranged a tube holder 5 for temporary holding the drill string when this is required.

Beside the feed beam 2 is arranged a (not shown) power and driving aggregate for proving pressure fluid etc to the rock drill rig and a lifting winch (not shown). A magazine 6 is arranged for receiving drill string components (indicated with interrupted line at 8), to be brought into respectively taken out from the rock drill rig in a manner that will be described below.

The magazine 6 can be constructed in various ways but is in FIG. 1 exemplified in the form of a generally horizontal table, which is tiltable such that drill string components 8 can be brought to roll towards a swing arm 7 for reception of drill string components 8.

In FIG. 1 is further indicated, with a dot interrupted line at 8", a drill string component in a position during a lifting phase which is a slanting position in respect of the feed beam 2.

This line at 8" in FIG. 1 is intended to illustrate an intermediate position during the lifting phase which is ended by the drill string component being in a position which is co-axial with an active drill string position of the rock drill rig. Lifting is performed with the aid of a lifting plug (25 see below) being threaded-in uppermost in the drill string component. The lifting plug is during this process in turn connected to a (not shown) lifting wire, which passes over a wire wheel (not shown) uppermost on the feed beam and with its second part extends essentially in parallel with the feed beam 2 to the lifting winch (not shown) being arranged in the region of the power and drive aggregate.

Furthermore, FIG. 1 shows a lifting plug 25 being gripped by a gripping unit 11 and being threaded into an end portion of a drill string component 8' being in a drill string position.

FIG. 1 further shows that said end portion is protruding out from the rotator device 4 such that this drill string component 8' is in an active drill string position A. The drill string component 8' has a female thread for engagement with a corresponding male thread on the plug 25.

Threading-on of a further, second drill string component 8" on the first drill string component 8' for the purpose of extending the drill string for subsequent lowering into the drill hole is essentially corresponding to the method for threading-on of a lifting plug. See below.

The gripping unit 11 is shown in a first position in FIG. 1, in which a gripping position is defined by the gripping unit 11 and which provides a gripping position axis G (see interrupted line in FIG. 1), is co-axial with said active drill string position A.

Further in this Figure is shown in greater detail a guiding beam 19, which is arranged to provide a stop for the swing arm 7 in an upwardly swung delivering position of a supported drill string component 8. Furthermore, the guiding beam 19 provides stop for the gripping unit 11 in the second position thereof. Support means in the form of a chute for supporting a drill string component is indicated with 7'.

The gripping unit 11, is supported by a swing unit 18 which is attached to the rig and supports the gripping unit 11 for swinging around a first swing axis A1 between the position shown in FIG. 1 (a first position) and a outwardly swung position (a second position), which is described below. The gripping unit 11 is not subject to this application and is therefore not described in detail here.

After having brought a further drill string component into a position above an existing one in position A (instead of the lifting plug 25 in FIG. 1), the drill string components are threaded together by the rotation means, whereupon the joint as usual is finally tightened by the rotator device 4. Thereupon the drill string can be lowered by slacking the lifting wire. (Joining is of course performed in the same way when the drill string has sunk through drilling.)

Thereupon the drill string is lowered down to the position shown in FIG. 1, whereby the next drill string component has reached the position being indicated with 8' with an end portion protruding out from the rotator device 4 and with the lifting plug 25 being above this drill string component. This lifting plug will now be released from the drill string.

The lifting plug 25 is a swivelling device and therefore has two mutually rotatable parts, namely an engagement portion, which at lowermost is provided with a male thread at its free end, which is directed against the drill string component, and a lifting portion, which outermost is provided with a lifting eye for co-operation with a lifting wire as is described above.

Figure 2:
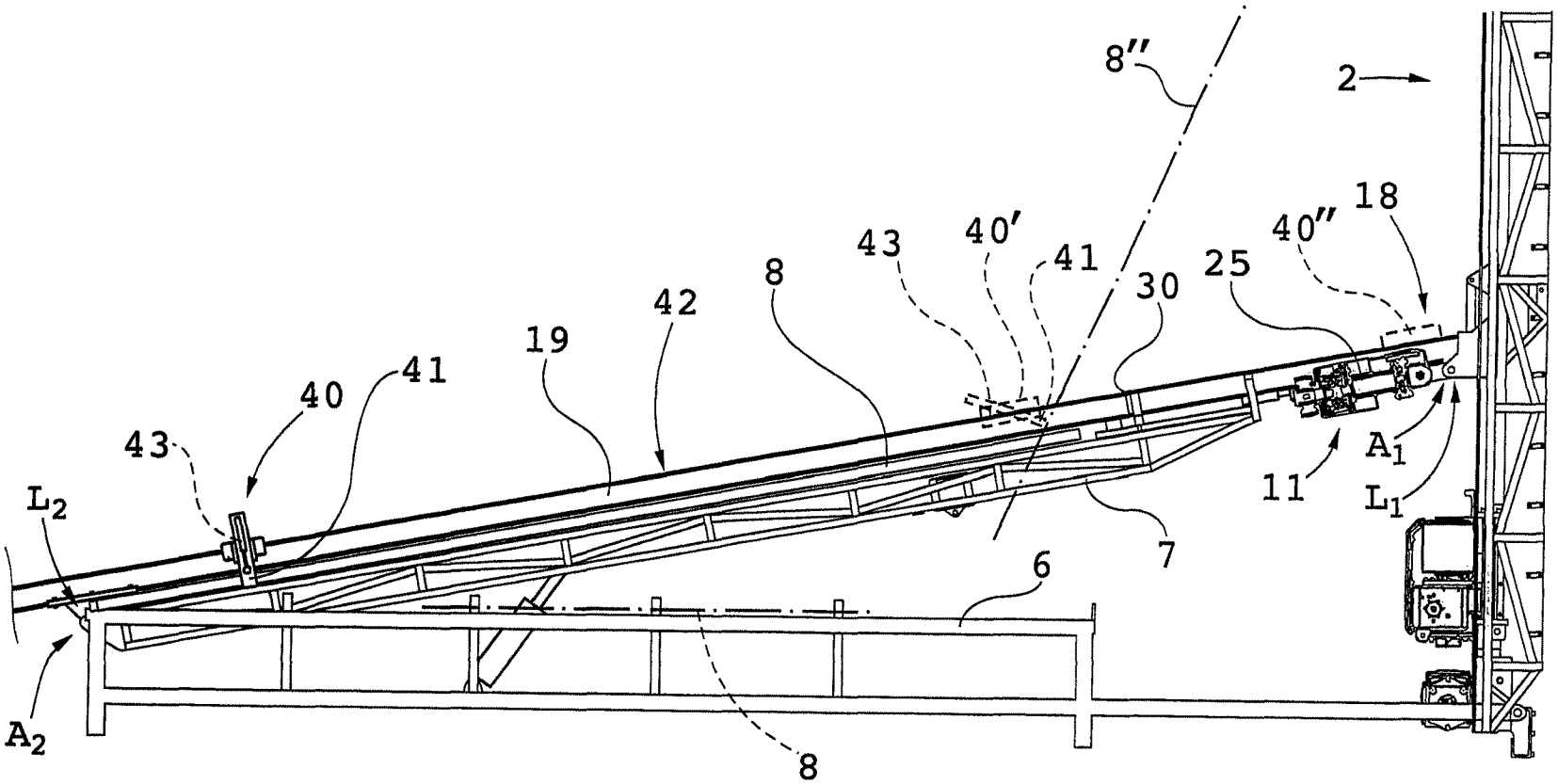
FIG. 2 shows a side view corresponding to FIG. 1 with the means of the handling device in another position, FIGS. 3*a* and *b* show in two different perspective views, a gripper shuttle belonging to the handling device.

FIG. 2 shows that said swing unit 18 has swung the gripping unit 11 with supported lifting plug 25 to the second position where the gripping position is aligned for co-operation with a drill string component 8 being supported by the swing arm 7 being connected to said magazine 6. This determined position of the gripping unit 11 is ensured by the guiding beam 19 forming a mechanical stop for the swing movement of the gripping unit 11 in said second position. Here the lifting plug will now be threaded to the drill string component 8 which, after release of the gripping unit, will be free to be lifted by the lifting wire.

FIG. 2 also shows that the swing arm 7 has swung up around a second swing axis A2 to the delivering position, wherein, correspondingly, the guiding beam 19 is a mechanical stop for the swing movement of the swing arm 7 in the delivering position.

The guiding beam 19 is provided with a longitudinal guide 42 for the drivingly displaceable gripper shuttle 40. The pivot 43 has a pivot axis essentially in parallel with the first and the second swing axes A1 and A2 for allowing swinging in the same plane that includes the drill string position and the delivering position.

The guiding gripper is arranged such that after gripping said drill string component 8, it guides the free end thereof for controlling its movement during the lifting process and for guiding this free end to be lined up with the drill string position A in the rig. With activated guiding gripper gripping a drill string component and running gripper shuttle it is arranged such that the guiding gripper follows the pivotal movement without being rotationally controlled in itself. For guiding purposes in order to come into the right position for gripping of a drill string component, on the one hand in the outermost position as is shown in FIG. 2, on the other hand in the inner position adjacent to the feed beam, however, active rotational control must be performed of the guiding gripper around the axis of the pivot 43. This is suitably accomplished by the gripper shuttle being provided with a rotational actuator for the guiding gripper 41, said rotational actuator can be in the form of a hydraulic cylinder or any other type of rotational actuator of a per se known kind, acting between two end positions according to the above.

With reference again to FIG. 2, there is shown that the gripper shuttle 40 with its guiding gripper 41 is in a first position (with full lines) in a first outermost position of the guiding beam in order there to grip the first end portion of the drill string component 8 intended for lifting, the other end portion of which being intended to be in threaded engagement with the lifting plug or the like for co-operation with said lifting winch.

In an intermediate position is shown the gripper shuttle, indicated with the reference numeral 40' with interrupted lines in FIGS. 1 and 2, guiding the drill string component 8".

The gripper shuttle is also shown indicated with the reference numeral 40" with interrupted lines in FIG. 2 in a second position in a second, inner position of the guiding beam close to the feed beam 2. Here, it is arranged, with the guiding gripper 41, to line up said gripped drill string component in the region of the drill string position. Normally, such an alignment can be performed against an alignment aid (not shown here) being normally arranged at the feed beam and being movable back and forth for guiding-in the incoming lower end of a drill string component.

Figure 3A:
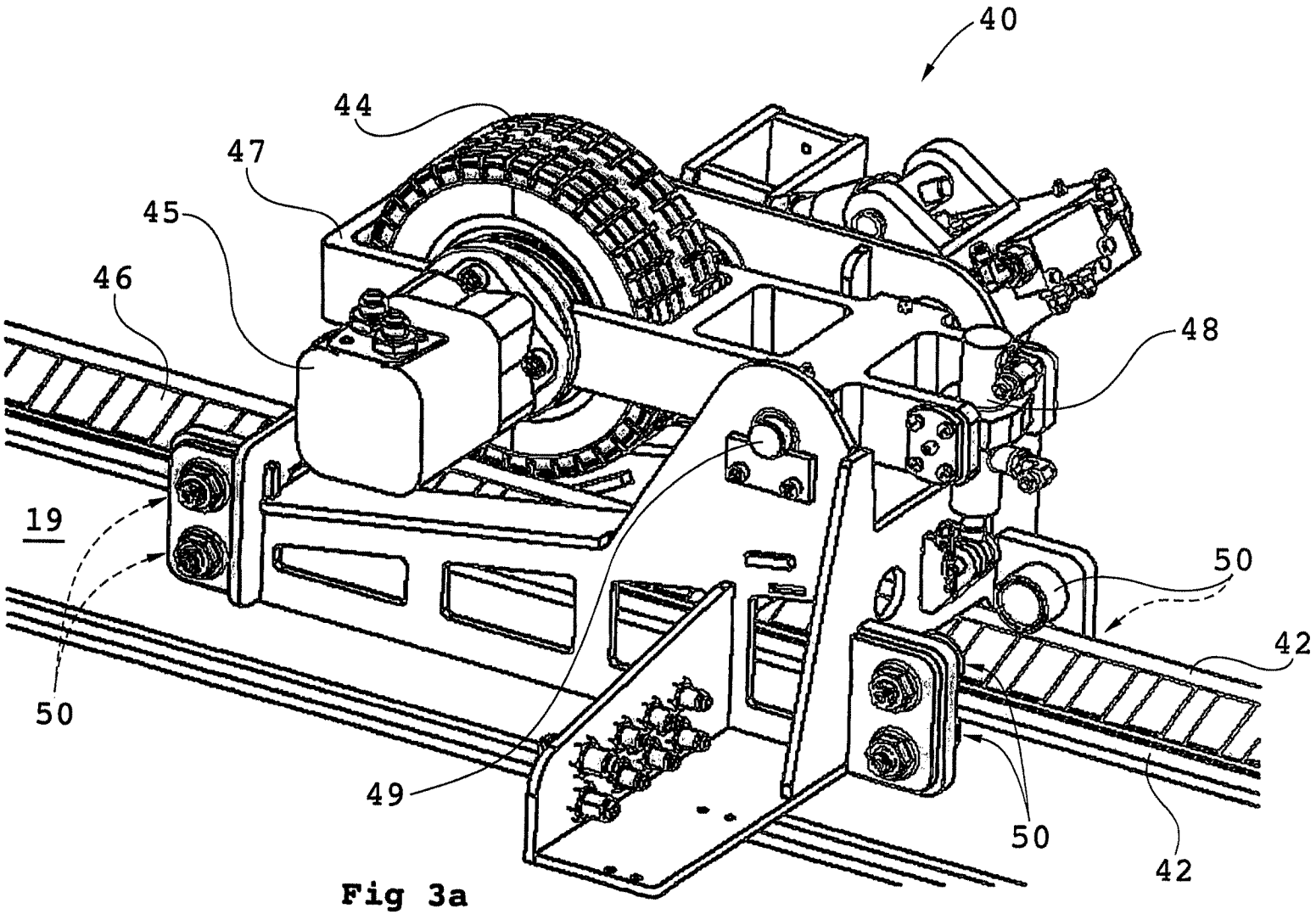
Figure 3B:
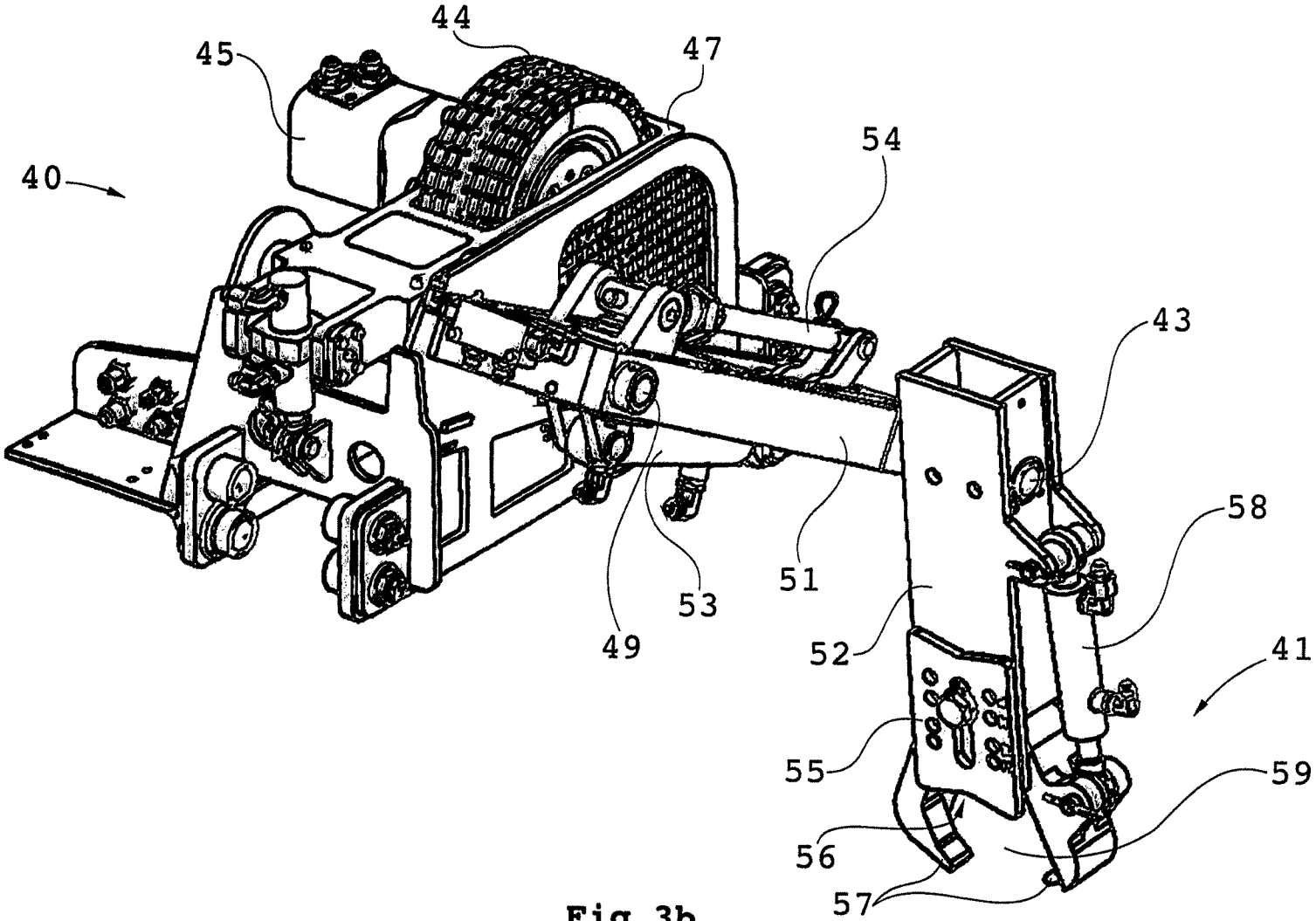

On FIGS. 3*a* and *b* is shown in a greater scale the gripper shuttle 40 being drivingly displaceable along the longitudinal guide 42 on the guiding beam 19. The gripper shuttle includes a guiding gripper 41 being arranged pivotal around the pivot 43 for guiding a first end portion of a drill string component. The gripper shuttle 40 further carries a drive motor 45 for driving a drive wheel 44 co-operating with a drive track 46 on the guiding beam 19. The drive wheel 44 is supported by a frame-shaped holder 47 which with the aid of a power unit 48 is displaceable in respect of a body of the gripper shuttle 40. The holder 47 is pivotal around an axis 49 which allows disengagement of the drive wheel from the drive track and pressure variation of the contact pressure of the drive wheel against the drive track by variation of static pressure/drive pressure provided to the power unit. Disengagement permits essentially free movement of the gripper shuttle along the longitudinal guide. The drive wheel according to the shown embodiment is a pneumatic wheel acting against an essentially flat drive track. As is shown in FIG. 3*a* the drive track is provided with a surface structure of short flat portions of varying height for increasing friction between the drive wheel and the drive track.

The guiding beam has a longitudinal guide 42 in the form of longitudinal in different direction sideways facing guiding strips arranged on the guiding beam. The gripper shuttle includes guiding means in the form of a set of pairs of guiding rolls 50 co-operating with the guiding strips, which engage on each side of the guiding strips and at a distance from each other as seen in a longitudinal direction of the guiding beam.

The guiding gripper 41 is positioned on an arm including an outer arm portion 52 which is pivotally connected over a pivot pin 43 with an inner arm portion 51, which in turn is pivotally connected over the shaft having an axis 49 with a main portion of the gripper shuttle. This is the same axis 49 as the one the holder 47 is pivotal around, but there is otherwise no connection between the movements of the holder 47 and of the inner arm portion 51.

The ability of the inner arm portion 51 to swing is free with exception from a lower swing limiting stop (not shown). Between the inner and outer arm portions there are, however, a power unit 53 active to ensure that the guiding gripper swings between a first position for gripping a drill string component in the drill string position and a second position for gripping a drill string component in a delivering position. This permits following a gripped drill string component as well as directing the guiding gripper 41 through the power unit 53. An adjustable end position limiting device 54 is arranged between the inner and outer arm portions to be used for adjusting the guiding gripper for gripping a drill string component in the first position, the drill string position. The arrangement with one arm including an inner and an outer arm portion being mutually pivotal to connect the guiding gripper to the gripper shuttle is advantageous since it permits softness in the system and thereby certain damping of the relatively great forces that can prevail during operation, since the controlled pivot joint between the arm portions can allow certain flexibility. Hereby a rigid connection between the guiding gripper and the gripper shuttle can be avoided.

The guiding gripper 41 is adjustable for adaption to different size drill string components. This can be accomplished by an adaptation plate 55 having V-shaped reception ends 56 being applied differently by choice in order to limit reception space 59 for a gripped drill string component differently. One example of how an adjustment plate 55 can be applied as desired is to provide it with a number of sets of lined-up holes, wherein each set corresponds to a certain setting when it is brought to co-operate with guiding pins arranged on the side of the guiding gripper.

57 indicates synchronously actuated grip jaws and 58 indicates a power cylinder for the manoeuvring thereof.

It is again referred to FIGS. 1 and 2. The guiding beam is pivotally attached at a first pivot axis L1 in connection with a region of the first swing axis A1 which preferably is such that the first pivot axis L1 is co-axial with the first swing axis A1. The guiding beam 19 is also pivotally attached at a second pivot axis L2 in connection with a region of a second swing axis A2 which preferably is such that the second swing axis L2 is co-axial with the second swing axis A2. Hereby a desired reference for stop of swing movements of the swing arm as well as the gripping unit be obtained when setting up and repositioning the rig in an easy way without the requirement of applying complicated measuring methods or the like since the guiding beam after adjustment of the rig will automatically have an adequate direction when a support (such as a magazine 6) for the guiding beam at the end facing away from the feed beam is anchored to the ground.

As is apparent and is shown in the Figures, the swing arm as well as the gripping unit swings in the shown embodiment and with the shown setting of the rock drill rig in a vertical plane or at least in a plane including an axis of the drill string position A in the rig, or in a plane being parallel to such a plane, whereby the axes A1 and A2 are (essentially) horizontal. If there is a need to position the feed beam laterally slanting, it should of course be necessary to have the corresponding obliqueness of the axis A1 and A2 and L1 and L2, respectively.

Thereupon the drill string is lifted further such that the next drill string component with its end portion finds itself in the position being shown in FIG. 1, whereupon the gripping unit 11 comes in and with the rotation means 14 grips the uppermost drill string component and with a first set of grippers 12 grips the next drill string component ("the first") for the purpose of alignment in connection with the rotation means 14 being driven for controlled unthreading of this drill string component.

Thereupon the thus released drill string component is gripped by said guiding gripper and through the movement of the gripper shuttle 40 is brought away from the feed beam 2 out from the position in parallel with the active drill string position with its lower end at the same time as the lifting wire is slacked in a controlled manner such that the drill string component finally reaches the delivering position. Here it and the lift plug can be gripped by the grippers of the gripping unit 11 for unthreading the latter. Lifting of the swing arm 7 for receiving the drill string component now occurs and when the unthreading is completed, the swing arm can be lowered for transporting away the supported drill string component to a magazine or the like. Thereupon the process can be repeated as many times as necessary.

The guiding beam can be attached with pivot pins being common elements with pins for said swing axis. Fastenings vis-à-vis the rig/the feed beam and the support/magazine respectively can be arranged with screw means, through welding etc. The longitudinal guide can be comprised of an external portion on the guiding beam such as side edges of flanges of an H-beam, an I-beam or the like. Also other guide solutions are within the scope of the invention.

The guiding beam can in a simplified form of the inventive handling device also be placed completely free from the feed beam and the rig. Also in this form it can be possible for the gripper shuttle to fulfil its main purposes:

1) to guide a lower end of a drill string component being lifted by a lifting wire during the process of adding a drill string component to the drill string and finally introduce it to a drill string position, 2) to extract a lower end of a drill string component in a drill string position and being lifted in a lifting wire from the drill string position and lead the lower end during the process of removing a drill string component from the drill string and finally position the drill string component on the magazine or the like.

The invention claimed is:

1. A handling device for handling drill string components in a rock drill rig which includes a rotator device being arranged for rotation and driving of a drill string component and being supported movable to and fro on a feed beam, the handling device comprising:

a drill string introducing unit configured to introduce drill string components into, and respectively remove drill string components from a drill string position of the rock drill rig, a guiding beam arranged to extend laterally from the feed beam while forming an angle thereto, and which includes a longitudinal guide, a gripper shuttle drivingly displaceable along the longitudinal guide, wherein the gripper shuttle includes a pivotally arranged guiding gripper for gripping a first end region of a drill string component, a second end region of which been arranged to be in engagement with a lifting plug, and a drive motor arranged on the gripper shuttle configured to drive a drive wheel for co-operation with a drive track on the guiding beam, wherein the drive wheel is disengageable to allow essentially free movement of the gripper shuttle along the longitudinal guide.

2. A handling device according to claim 1, wherein the drive wheel is a wheel acting against an essentially planar drive track.

3. A handling device according to claim 2, wherein a contact pressure of the drive wheel against the drive track is adjustable.

4. A handling device according to claim 3, further comprising:

a holder configured to support the drive wheel; and a power unit configured to move the drive wheel with respect to a body of the gripper shuttle.

5. A handling device according to claim 1, wherein the drive wheel is disengageable by being positioned out of engagement with said drive track.

6. A handling device according to claim 1, wherein the longitudinal guide includes guiding strips arranged lengthwise on the guiding beam and facing different directions sideways, and wherein the gripper shuttle includes a guide configured to cooperate with the guiding strips.

7. A handling device according to claim 1, wherein the guiding gripper is positioned on an arm which is pivotal with respect to a main portion of the gripper shuttle.

8. A handling device according to claim 7, wherein the pivotal arm is pivotal between a first position for gripping a drill string component in the drill string position and a second position for gripping a drill string component in a delivering position.

9. A handling device according to claim 8, wherein the first position is an adjustable position.

10. A handling device according to claim 1, wherein the guiding gripper is adjustable for adaption to different sized drill string components.

11. A handling device according to claim 1, wherein the guiding beam at an end is attachable in the region of the feed beam.

12. A handling device according to claim 11, wherein the guiding beam is attachable pivotal around a first pivot axis in connection with said feed beam.

13. A handling device according to claim 11, further comprising:

a gripping unit arranged to engage an end portion of a first drill component respectively an end portion of a second drill string component.

14. A handling device according to claim 1, wherein the guiding beam has linear extension.

15. A rock drill rig, comprising:

a rotator device for rotation and driving a drill string and being supported movable to and fro by a feed beam, and a handling device comprising a drill string introducing unit configured to introduce drill string components into, and respectively remove drill string components from, a drill string position of the rock drill rig, a guiding beam arranged to extend laterally from the feed beam while forming an angle thereto, and which includes a longitudinal guide, a gripper shuttle drivingly displaceable along the longitudinal guide, wherein the gripper shuttle includes a pivotally arranged guiding gripper for gripping a first end region of a drill string component, a second end region of which been arranged to be in engagement with a lifting plug, and a drive motor arranged on the gripper shuttle configured to drive a drive wheel for co-operation with a drive track on the guiding beam, wherein the drive wheel is disengageable to allow essentially free movement of the gripper shuttle along the longitudinal guide.

* * * * *